US009933734B2

(12) United States Patent
Oi

(10) Patent No.: US 9,933,734 B2
(45) Date of Patent: Apr. 3, 2018

(54) FIXING APPARATUS AND HEATER FOR USE IN THE APPARATUS

(71) Applicant: CANON KABUSHIKI KAISHA, Tokyo (JP)

(72) Inventor: Ken Oi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/247,195

(22) Filed: Aug. 25, 2016

(65) Prior Publication Data

US 2017/0060057 A1 Mar. 2, 2017

(30) Foreign Application Priority Data

Aug. 27, 2015 (JP) ..... 2015-167521

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
None
See application file for complete search history.

(56) References Cited

U.S. PATENT DOCUMENTS 8,471,178 B2 * 6/2013 Taniguchi ..... G03G 15/2042 219/216
8,552,342 B2 * 10/2013 Sakakibara ..... H05B 3/0095 219/216
8,698,046 B2 * 4/2014 Shimura ..... H05B 3/0095 219/216
9,095,003 B2 * 7/2015 Sakakibara ..... H05B 3/0095
9,098,035 B2 * 8/2015 Nakahara ..... G03G 15/2053
9,445,457 B2 * 9/2016 Sakakibara ..... H05B 3/0095
9,494,899 B2 * 11/2016 Nakahara ..... G03G 15/2053
2011/0062140 A1 * 3/2011 Sakakibara ..... H05B 3/0095 219/216

(Continued)

FOREIGN PATENT DOCUMENTS

JP H08234598 A 9/1996
JP 2000223244 A 8/2000

(Continued)

*Primary Examiner* — Joseph M Pelham
(74) *Attorney, Agent, or Firm* — Canon U.S.A., Inc., IP Division

(57) ABSTRACT

A fixing apparatus includes a tubular film and a heater in contact with an inner surface of the film. The heater includes a long thin substrate, a first heat generation resistor extending in a longitudinal direction of the substrate, a second heat generation resistor extending in the longitudinal direction of the substrate, and a conductor electrically connecting the first heat generation resistor and the second heat generation resistor to each other. At least part of the conductor is disposed in an area, in the longitudinal direction, in which the first heat generation resistor is disposed. In a range of 25° C. to 900° C., the conductor has a resistance lower than a total resistance of the first heat generation resistor and the second heat generation resistor. The conductor has a temperature coefficient of resistance larger than a temperature coefficient of resistance of the first heat generation resistor.

10 Claims, 14 Drawing Sheets

(56) References Cited

U.S. PATENT DOCUMENTS

| | | | | |
|---|---|---|---|---|
| 2012/0121306 | A1* | 5/2012 | Shimura | H05B 3/0095 399/329 |
| 2012/0308280 | A1* | 12/2012 | Tsuruya | G03G 15/2042 399/329 |
| 2013/0251428 | A1* | 9/2013 | Ueno | H05B 3/12 399/333 |
| 2013/0343791 | A1* | 12/2013 | Shimura | G03G 15/2053 399/329 |
| 2014/0003848 | A1* | 1/2014 | Sakakibara | H05B 3/0095 399/335 |
| 2014/0169845 | A1* | 6/2014 | Nakahara | G03G 15/2053 399/328 |
| 2015/0289317 | A1* | 10/2015 | Sakakibara | H05B 3/0095 399/329 |
| 2015/0293483 | A1* | 10/2015 | Nakahara | G03G 15/2053 399/333 |

FOREIGN PATENT DOCUMENTS

| | | | |
|---|---|---|---|
| JP | 2000260553 | A | 9/2000 |
| JP | 2014228684 | A | 12/2014 |

* cited by examiner

FIXING APPARATUS AND HEATER FOR USE IN THE APPARATUS

BACKGROUND OF THE INVENTION

Field of the Invention

The present disclosure relates to a fixing apparatus for fixing a toner image onto a recording medium and relates to a heater for use in the apparatus.

Description of the Related Art

Image forming apparatuses, such as electrophotographic copying machines and printers, are equipped with a fixing apparatus. Japanese Patent Laid-Open No. 08-234598 discloses a ceramic heater including a heat generation resistor disposed on a ceramic substrate, feeding electrodes for supplying electric power to the heat generation resistor, and an overcoat layer disposed so as to coat the heat generation resistor.

With this fixing apparatus, energization of the heat generation resistor is controlled so that the ceramic heater is heated, and the ceramic heater is pushed against a pressure roller with a heat-resistive fixing film in between. A recording medium on which an unfixed toner image is formed passes between the fixing film and the pressure roller, so that the toner image is fixed on the recording medium. In such a fixing apparatus, an energization control unit that controls energization of the heat generation resistor can fail to operate properly (cannot control energization). In this case, abnormal heat generation of the ceramic heater has to be prevented.

FIG. 14 illustrates a power feeding circuit for a heater 1301. In FIG. 14, a current suppression device 1305 having positive temperature coefficient (PTC) properties, a protection device 1309, such as a thermistor, an energization control device 1401, such as a relay, and an alternate-current source are connected in series to the heater 1301. The energization control device 1401 is controlled by a CPU 1402 on the basis of the detection result of a temperature sensor 1310 that detects the temperature of the heater 1301.

When the energization control device 1401 is damaged due to short-circuit, the heater 1301 can excessively rise in temperature and be broken due to thermal stress. Although the protection device 1309 is provided for an excessive rise in the temperature of the heater 1301, the heater 1301 can be broken before the protection device 1309 operates owing to a delay in response of the protection device 1309. However, with the configuration of FIG. 14, the resistance of the current suppression device 1305 increases when the current suppression device 1305 is heated. This reduces the amount of current flowing through a heat generation resistor of the heater 1301 even if the energization control device 1401 is damaged due to shorts-circuit, preventing the heat generation resistor from overheating. This decreases the rate of temperature rise of the heater 1301 compared with a case without the current suppression device 1305, preventing the heater 1301 from being broken before the protection device 1309 operates.

However, in a case in which a current suppression device having a positive temperature coefficient property is used in a fixing apparatus that uses a ceramic heater, the current suppression device has to be connected in series to the heater and to dispose the current suppression device in the vicinity of the heater. Furthermore, with the size reduction of image forming apparatuses, it has become difficult to dispose a reinforced insulation structure defined by a safety standard, such as IEC60950, between a power supply to a ceramic heater and the ground. For this reason, a protection device (for example, a thermal cutoff) adhering to the standard has to be connected in series to the ceramic heater.

One example of a position at which the current suppression device can easily receive the heat of the heater is the back of a heater holder (the opposite surface of the heater holder from the surface that holds the heater). However, in addition to the current suppression device, a protection device and a temperature sensor have to be disposed on the back of the heater holder. For this reason, the configuration in which the current suppression device is disposed on the back of the heater holder hinders reduction in the size of the product.

SUMMARY OF THE INVENTION

The present disclosure provides a compact fixing apparatus in which breakage of its heater can be avoided.

A heater according to another aspect of the present disclosure includes a long thin substrate, a first heat generation resistor, a second heat generation resistor, and a conductor. The first heat generation resistor is disposed on the substrate and extends in a longitudinal direction of the substrate. The second heat generation resistor is disposed on the substrate and extends in the longitudinal direction of the substrate. The conductor electrically connects the first heat generation resistor and the second heat generation resistor to each other so that a current flows in the longitudinal direction in each of the first heat generation resistor and the second heat generation resistor. At least part of the conductor is disposed in an area, in the longitudinal direction, in which the first heat generation resistor is disposed. In a range of 25° C. to 900° C., the conductor has a resistance lower than a total resistance of the first heat generation resistor and the second heat generation resistor. The conductor has a temperature coefficient of resistance larger than a temperature coefficient of resistance of the first heat generation resistor.

Further features of the present invention will become apparent from the following description of exemplary embodiments with reference to the attached drawings.

DESCRIPTION OF THE EMBODIMENTS

Embodiments of the present disclosure will be described hereinbelow with reference to the drawings. It is to be understood that the sizes, materials, and shapes of the components described in the embodiments and their relative dispositions may be changed as appropriate according to the configuration of the apparatus to which the present discloser is applied and various conditions, and the scope of the present disclosure is not limited to the embodiments.

First Embodiment

Configuration of Image Forming Apparatus

Figure 1:
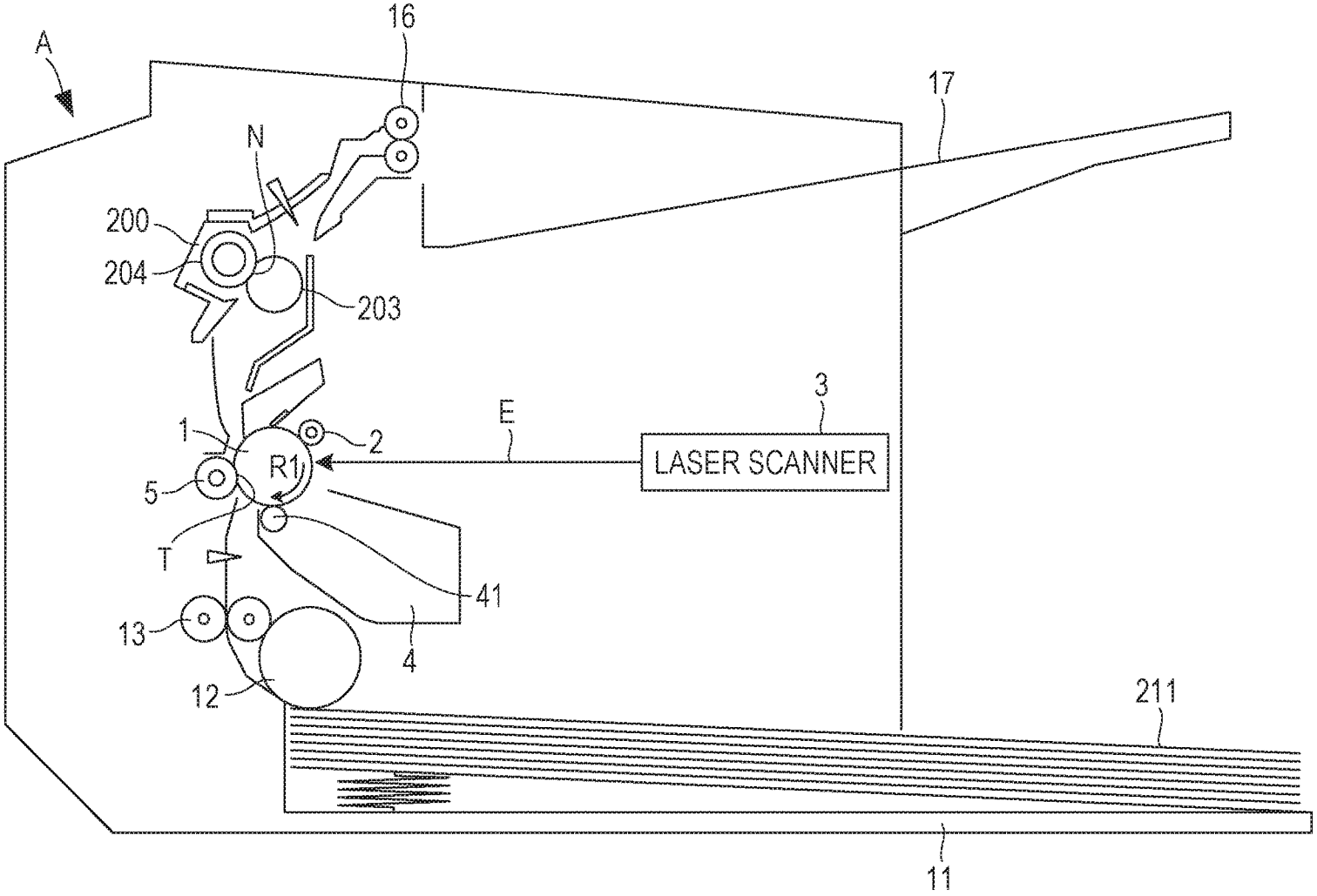
FIG. 1 is a schematic cross-sectional view of an image forming apparatus according to a first embodiment of the present disclosure.

FIG. 1 is a schematic cross-sectional view of an image forming apparatus A according to a first embodiment. First, the configuration of a laser printer (hereinafter referred to as an image forming apparatus) will be described with reference to FIG. 1. The image forming apparatus A shown in FIG. 1 includes a drum-type electrophotographic photoconductor 1 serving as an image bearing member (hereinafter referred to as a photoconductive drum 1).

The photoconductive drum 1 is rotationally driven in the direction of arrow R1 at a predetermined processing speed (a circumferential speed) by a driving unit (not shown). The surface of the photoconductive drum 1 is uniformly charged to a predetermined polarity and potential by a charging roller 2 serving as a charging means. The charged photoconductive drum 1 is irradiated with a laser beam E from a laser scanner 3 serving as an exposing means to form a static latent image. The laser scanner 3 performs scanning-exposure, whose ON/Off is controlled according to image information, on the photoconductive drum 1, so that electrical charge of the exposed portion is removed, and a static latent image is formed on the surface of the photoconductive drum 1. The static latent image is developed by a developing unit 4 serving as a developing means into a visible image. Specifically, the static latent image is supplied with a toner (a developer) by developing roller 41, so that the static latent image is developed into a toner image.

Then, the toner image on the photoconductive drum 1 is transferred onto the surface of each of sheet-like recording media 211 (printing media). The recording media 211 are contained in a paper feed tray 11 and are fed by a paper feeding roller 12 one by one. Each recording medium 211 is conveyed to a transfer nip T between the photoconductive drum 1 and a transfer roller 5 by a conveying roller 13 and so on. The toner image on the photoconductive drum 1 is transferred onto the fed and conveyed recording medium 211 at predetermined timing by application of a transfer bias to the transfer roller 5 serving as a transfer unit.

The recording medium 211 on which the toner image is transferred is then conveyed to a fixing apparatus 200 serving as a fixing means. The recording medium 211 is nipped, heated, and pressed at a fixing nip N between a fixing film 203 and a pressure roller 204 (a pressure member) of the fixing apparatus 200, so that the toner image is fixed to the surface of the recording medium 211. Then, the recording medium 211 on which the toner image is fixed is discharged by a discharge roller 16 onto an output tray 17 disposed on the top of the image forming apparatus A.

Figure 2:
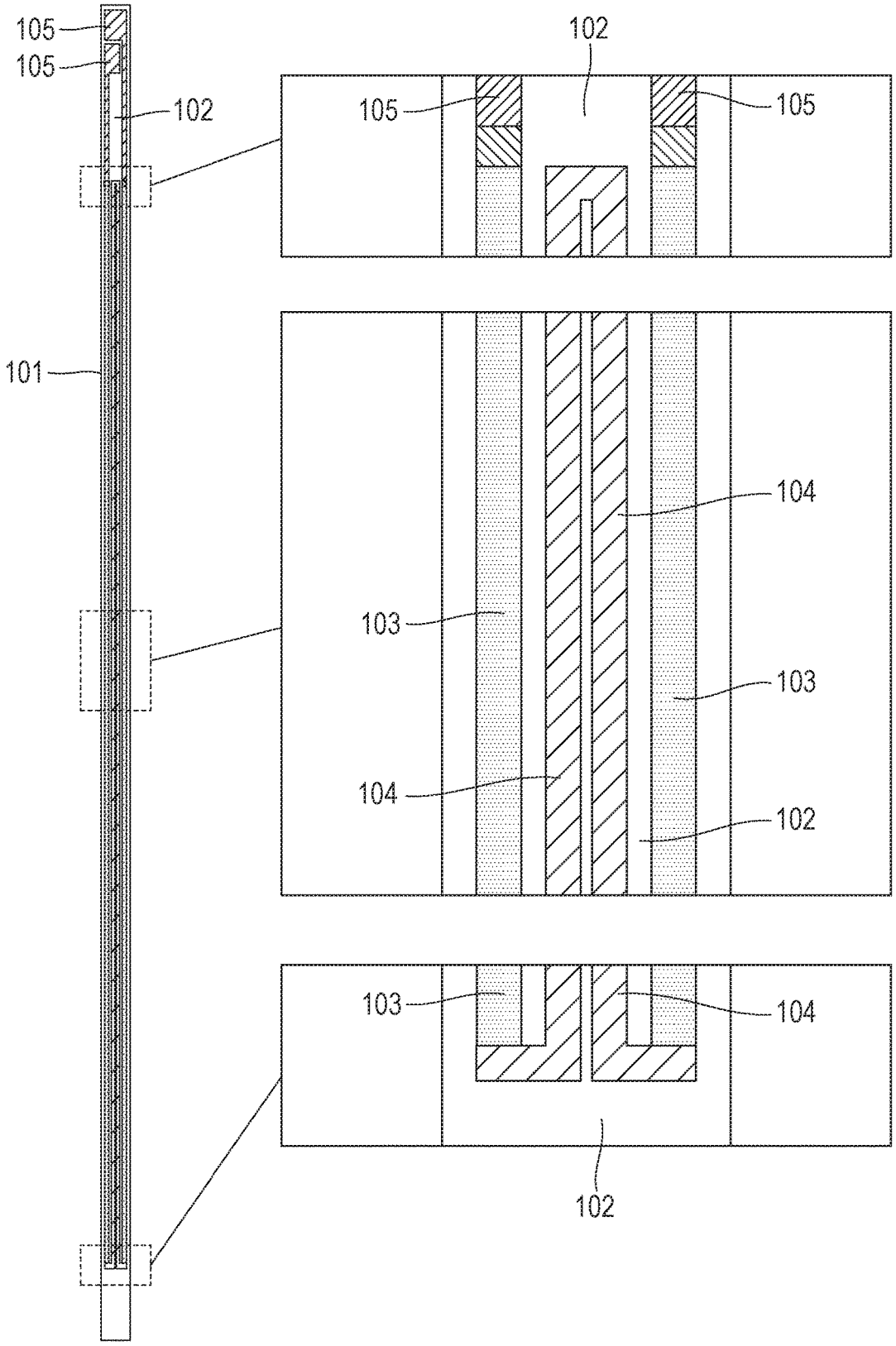
FIG. 2 is a schematic diagram of a ceramic heater according to the first embodiment.

FIG. 2 is a schematic diagram of a ceramic heater 101, which is a long-thin-plate-like heater with low heat capacity. The ceramic heater 101 includes a ceramic substrate 102 (a substrate), two heat generation resistors (a first heat generation resistor and a second heat generation resistor) 103, a heat receiving conductor (a conductor) 104, and conducting portions 105. The ceramic substrate 102 is a long thin alumina plate having insulating properties and a high thermal conductivity of about 20 W/(m·K). The heat generation resistors 103 are disposed on the ceramic substrate 102 and are supplied with electric power via the conducting portions 105.

The heat receiving conductor 104 is disposed on the surface of the ceramic substrate 102 on which the heat generation resistors 103 are disposed. The length of the heat receiving conductor 104 in the longitudinal direction of the ceramic substrate 102 is substantially the same as the lengths of the heat generation resistors 103 in the longitudinal direction of the ceramic substrate 102. The thicknesses of the heat generation resistors 103 and the thickness of the heat receiving conductor 104 are substantially the same. The lengths of the heat generation resistors 103 are substantially the same as the width of a recording medium 211 of a maximum size that the printer A can support.

The two heat generation resistors 103 are disposed on the ceramic substrate 102. The first heat generation resistor 103 and the second heat generation resistor 103 are disposed parallel to each other. The heat receiving conductor 104 is long in the longitudinal direction of the heat generation resistors 103 and is disposed between the two heat generation resistors 103 in the lateral direction of the heat generation resistors 103. The lengths of the heat generation resistors 103 in the longitudinal direction of the heat generation resistors 103 and the length of the heat receiving conductor 104 in the longitudinal direction of the heat generation resistors 103 are substantially the same. The ceramic heater 101 further includes a glass protective layer 201 (shown in FIG. 3A) having high insulation properties for coating the heat generation resistors 103, the heat receiving conductor 104, and part of the conducting portions 105.

The resistance $R_S$ of the heat receiving conductor 104 is smaller than the resistance $R_H$ of the heat generation resistors 103 (the total resistance of the first heat generation resistor and the second heat generation resistor) in the range of 25° C. to 900° C. The temperature coefficient of resistance $TCR_S$ of the heat receiving conductor 104 is larger than the temperature coefficient of resistance $TCR_H$ of the heat generation resistors 103 and has a positive temperature coefficient property. In other words, the resistance $R_S$ of the heat receiving conductor 104 increases as the temperature of the heat receiving conductor 104 increases. The heat receiving conductor 104 is electrically connected in series to the heat generation resistors 103 in the vicinity of the ends of the heat receiving conductor 104 in the longitudinal direction of the ceramic substrate 102.

The heat receiving conductor 104 is disposed inside the heat generation resistors 103, which are respectively disposed in the vicinity of both sides of the ceramic substrate 102 in the lateral direction, along the heat generation resistors 103 in the longitudinal direction of the ceramic substrate 102. This disposition allows the heat receiving conductor 104 to be heated via the ceramic substrate 102 when the heat generation resistors 103 generate heat. The total resistance $R_{H\text{-}25}$ of the heat generation resistors 103 is about 59Ω under an environment of 25° C.

The heat generation resistors 103 are formed of a material having a temperature coefficient of resistance $TCR_H$ of 700 ppm/deg (for example, a mixture of silver and palladium). The heat generation resistors 103 are about 0.9 mm in width and about 220 mm in length. The heat receiving conductor 104 is about 0.7 mm in width, about 10 μm in thickness, and about 440 mm in total length, as shown in FIG. 2. The heat receiving conductor 104 is formed of a material containing silver as the main component. The total resistance $R_{S\text{-}25}$ of the heat receiving conductor 104 at 25° C. is about 1Ω. The temperature coefficient of resistance $TCR_S$ of the heat receiving conductor 104 is about 3,000 ppm/deg. Thus, the temperature coefficient of resistance $TCR_S$ of the heat receiving conductor 104 of this embodiment is four or more times as large as the temperature coefficient of resistance $TCR_H$ of the heat generation resistors 103. The resistance $R_S$ of the heat receiving conductor 104 is 5% or less of the total resistance $R_H$ of the heat generation resistors 103 in the range of 25° C. to 900° C.

Figure 3A:
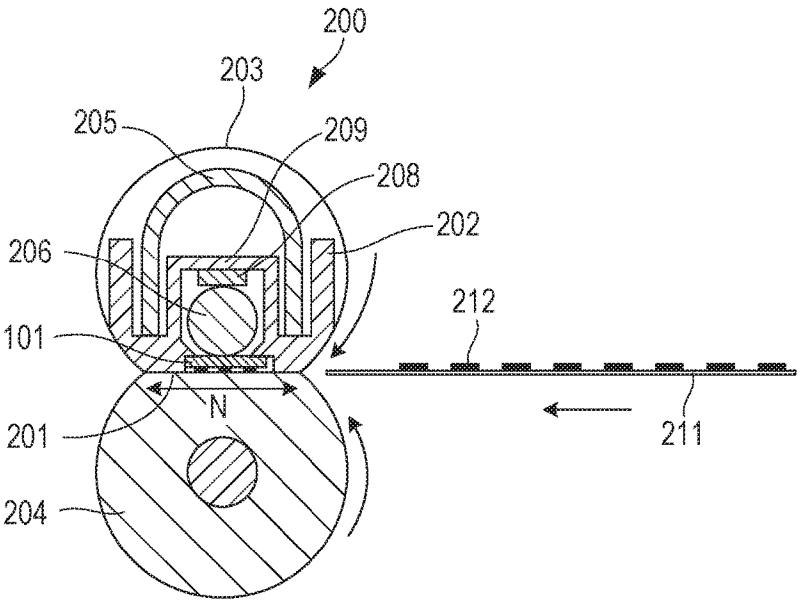
FIG. 3A is a schematic cross-sectional view of a fixing apparatus according to the first embodiment.
Figure 3B:
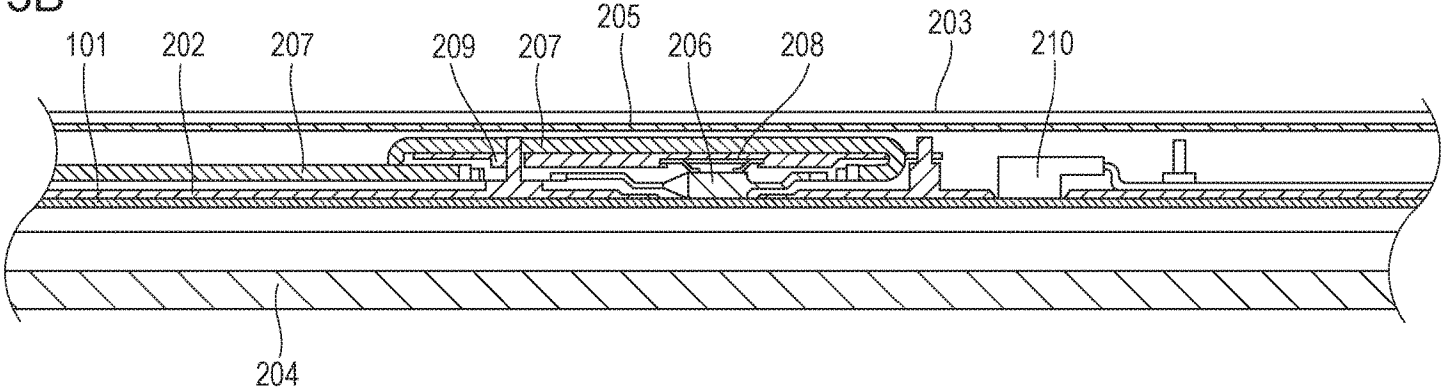
FIG. 3B is a schematic longitudinal sectional view of the fixing apparatus according to the first embodiment.

FIGS. 3A and 3B are schematic sectional views of the fixing apparatus 200 according to the first embodiment. FIG. 3A is a schematic cross-sectional view of the fixing apparatus 200 taken in a direction perpendicular to the longitudinal direction of the ceramic heater 101. FIG. 3B is a schematic longitudinal sectional view of the fixing apparatus 200 taken in a direction perpendicular to the lateral direction of the ceramic heater 101. The glass protective layer 201 protects the surface of the ceramic heater 101. A heater holder 202 supports the ceramic heater 101. A stay 205 is made of metal and enhances the rigidity of the heater holder 202.

The ceramic heater 101 is firmly supported by being fit in a groove, extending in the longitudinal direction of the heater holder 202, in the lower surface of the heater holder 202. The pressure roller 204 is in pressure-contact with the ceramic heater 101 with the heat-resistant fixing film 203 in between. This allows the fixing film 203 to slide with respect to the ceramic heater 101. A temperature fuse 206 is a protection device that prevents the ceramic heater 101 from excessively increasing in temperature. The temperature fuse 206 is connected in series to the ceramic heater 101 with an electrical cable 207 and is pressed against the ceramic heater 101 with a spring 208.

A spring support member 209 indirectly fixes the spring 208 to the heater holder 202. A temperature sensor 210 (a thermistor) is a device for detecting the temperature of the ceramic heater 101. By controlling the electric power to the ceramic heater 101 on the basis of the temperature of the ceramic heater 101 detected by the temperature sensor 210, the temperature of the ceramic heater 101 is controlled.

The recording medium 211 on which unfixed toner images 212 formed by an image forming unit (not shown) is formed passes through the fixing nip N formed by the ceramic heater 101 and the pressure roller 204 via the fixing film 203. Since the recording medium 211 is nipped and conveyed through the fixing nip N together with the fixing film 203, the heat of the ceramic heater 101 is transmitted to the recording medium 211 via the fixing film 203, so that the unfixed toner images 212 are fixed to the surface of the recording medium 211 by heat. Then, the recording medium 211 that has passed through the fixing nip N is separated from the surface of the fixing film 203 and is conveyed.

Figure 4:
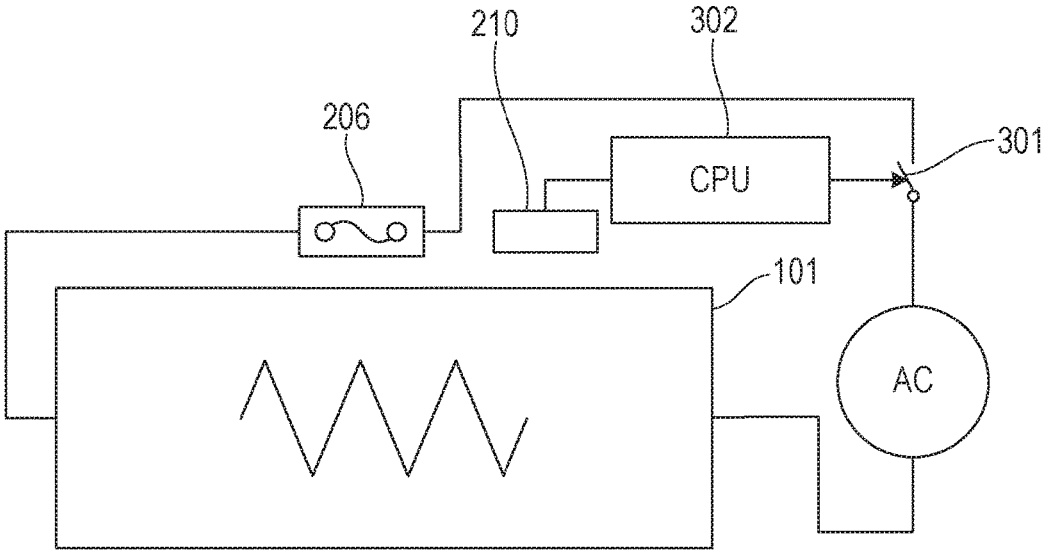
FIG. 4 is a schematic electrical circuit diagram of the fixing apparatus according to the first embodiment.

FIG. 4 is a schematic diagram of an electrical circuit that the ceramic heater 101 connects to. The ceramic heater 101 is connected in series to the temperature fuse 206, an energization control device 301, and an alternate-current source AC. The energization control device 301 is controlled by a CPU 302 on the basis of the temperature detection result using the temperature sensor 210. If the energization control device 301 breaks down to become unable to control power supply to the ceramic heater 101, the ceramic heater 101 can heat abnormally.

In such a case, the temperature fuse 206 operates to urgently interrupt the power to the heat generation resistors 103, thereby preventing breakage of the ceramic heater 101. The relationship among the temperature T of the ceramic heater 101, the resistance $R_H$ of the heat generation resistors 103, the temperature coefficient of resistance $TCR_H$ of the heat generation resistors 103, and the resistance $R_{H\text{-}25}$ of the heat generation resistors 103 under an environment of 25° C. is expressed as the following Eq. (1). The relationship among the temperature T of the ceramic heater 101, the resistance $R_S$ of the heat receiving conductor 104, the temperature coefficient of resistance $TCR_S$ of the heat receiving conductor 104, and the resistance $R_{S\text{-}25}$ of the heat receiving conductor 104 under an environment of 25° C. is expressed as the following Eq. (2).

$$R_H = R_{H\text{-}25} \times \{1 + TCR_H \times (T - 25°\ C.)\} \quad (1)$$

$$R_S = R_{S\text{-}25} \times \{1 + TCR_S \times (T - 25°\ C.)\} \quad (2)$$

Since the heat from the heat generation resistors 103 is transmitted to the heat receiving conductor 104 via the ceramic substrate 102, the heat receiving conductor 104 is heated to the temperature T of the ceramic heater 101. Since the temperature coefficient of resistance $TCR_S$ of the heat receiving conductor 104 is a positive temperature coefficient, the resistance $R_S$ of the heat receiving conductor 104 increases as the temperature of the heat receiving conductor 104 increases.

Since the temperature coefficient of resistance $TCR_S$ of the heat receiving conductor 104 is set larger than the temperature coefficient of resistance $TCR_H$ of the heat generation resistors 103, the rate of increase in the resistance $R_S$ of the heat receiving conductor 104 is higher than the rate of increase in the resistance $R_H$ of the heat generation resistors 103. The ceramic heater 101 according to the first embodiment can convert a power of about 880 W to heat when a voltage of 230 Vac is applied by a commercial power supply.

Figure 5A:
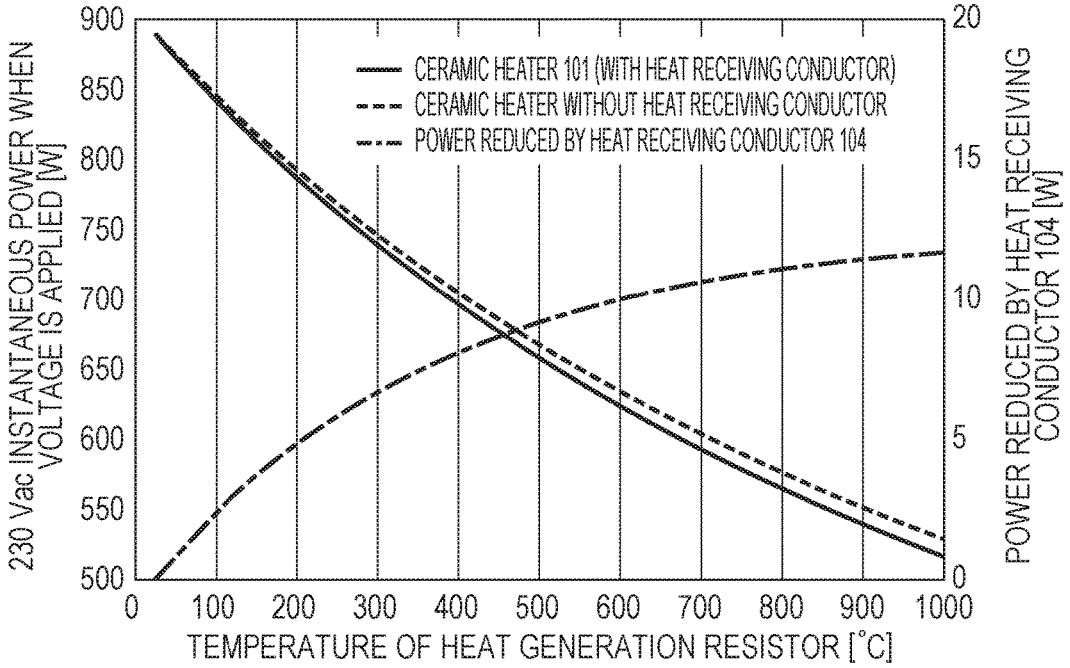
FIG. 5A is a graph showing the relationship among the temperature of heat generation resistors, electric power that the ceramic heater can convert to heat, and electric power that can be reduced by a heat receiving conductor.
Figure 5B:
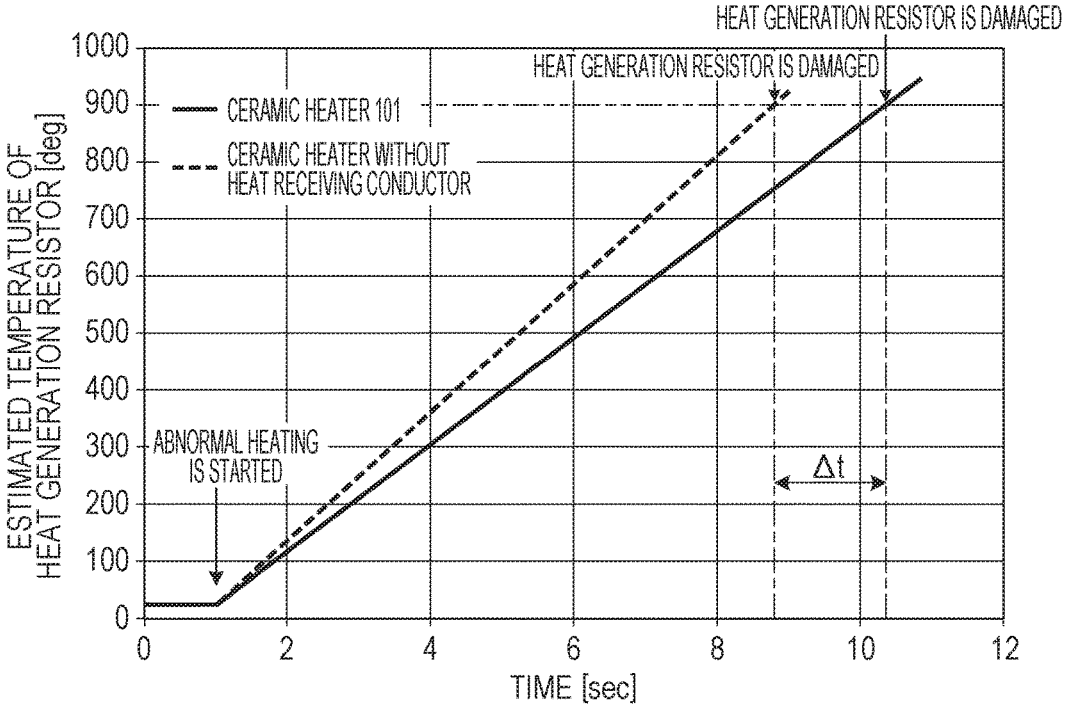
FIG. 5B is a graph showing the time taken to damage heat generation resistors.

FIGS. 5A and 5B are graphs illustrating an increase in the temperature of the heat generation resistors 103. FIG. 5A shows the relationship among the temperature of the heat generation resistors 103, electric power that the ceramic heater 101 can convert to heat, and electric power that can be reduced by the heat receiving conductor 104 when a voltage of 230 Vac is applied to the ceramic heater 101 by a commercial power supply. As shown in FIG. 5A, both the ceramic heater 101 including the heat receiving conductor 104 according to this embodiment and a ceramic heater without the heat receiving conductor 104 decrease in power that can be converted to heat as the temperature of the heat generation resistors 103 rises. This is because the temperature coefficients of resistances of the heat generation resistors 103 of both of the ceramic heaters are positive temperature coefficients.

In this embodiment, an increase in the temperature of the heat generation resistors 103 increases the temperature and the resistance $R_S$ of the heat receiving conductor 104. Since the temperature coefficient of resistance $TCR_S$ of the heat receiving conductor 104 is set larger than the temperature coefficient of resistance $TCR_H$ of the heat generation resistors 103, the degree of an increase in the resistance ($R_H$+$R_S$) of the ceramic heater 101 including the heat receiving conductor 104 is higher than the degree of an increase in the resistance ($R_H$) of the ceramic heater without the heat receiving conductor 104.

As a result, the higher the temperature of the heat generation resistors 103, the smaller the power that the ceramic heater 101 including the heat receiving conductor 104 can convert to heat, compared with the power that the ceramic heater without the heat receiving conductor 104 can convert to heat. The result of an experiment performed by the inventors shows that the temperature of the heat generation resistors 103 that causes the breakage of the ceramic heater 101 is about 900° C. With the ceramic heater without the heat receiving conductor 104, the resistance $R_{H\text{-}1000}$ of the heat generation resistors 103 is about 96Ω, with the heat generation resistors 103 at a temperature of about 900° C., and the power when a voltage of 230 Vac is applied from a commercial power supply is about 550 W.

With the ceramic heater 101 including the heat receiving conductor 104 according to this embodiment, when the temperature of the heat generation resistors 103 is about 900° C., the resistance $R_{H\text{-}1000}$ of the heat generation resistors 103 is about 94.3Ω, and the resistance $R_{S\text{-}1000}$ of the heat receiving conductor 104 is about 3.7Ω. As described above, the resistance $R_{H\text{-}25}$ of the heat generation resistors 103 is about 59Ω, and the resistance $R_{S\text{-}25}$ of the heat receiving conductor 104 is about 1Ω under an environment of 25° C. (a normal temperature). In other words, in this embodiment, the resistance of the heat receiving conductor 104 is 5% or less of the resistance of the heat generation resistors 103 under the environment of temperatures from 25° C. to 900° C.

The combined resistance of the heat generation resistors 103 and the heat receiving conductor 104 ($R_{H\text{-}1000}$+$R_{S\text{-}1000}$) is about 98Ω, and the power when a voltage of 230 Vac is applied from a commercial power supply under a temperature environment of 900° C. is about 540 W. In other words, the power supplied to the ceramic heater 101 including the heat receiving conductor 104 according to this embodiment is smaller than the power supplied to the ceramic heater without the heat receiving conductor 104.

Thus, the amount of power that the ceramic heater 101 can convert to heat decreases as the temperature of the heat generation resistors 103 increases, as described above. This increases the degree of increase in temperature of the ceramic heater 101 as the temperature of the heat generation resistors 103 increases. As a result, comparison between the ceramic heater without the heat receiving conductor 104 and the ceramic heater 101 with the heat receiving conductor 104 shows that the time taken to reach the same temperature is longer with the ceramic heater 101 as the temperature increases. In other words, the heater 101 can gain time until the temperature fuse 206 operates.

The inventors intentionally overheated a fixing apparatus that uses a ceramic heater without the heat receiving conductor 104 and the fixing apparatus 200 that uses the ceramic heater 101 according to this embodiment, with the temperature fuse 206 removed. FIG. 5B is a graph showing the relationship between the time taken to damage the ceramic heaters and the estimated temperature of the heat generation resistors 103. As shown in FIG. 5B, the time taken to damage the heat generation resistors 103 of the ceramic heater 101 was longer by Δt minutes than the time taken to damage the heat generation resistors 103 of the ceramic heater without the heat receiving conductor 104. The time taken to damage the heat generation resistors 103 of the ceramic heater 101 was longer by about 10% of the time taken to damage the heat generation resistors 103 of the ceramic heater without the heat receiving conductor 104.

When the fixing apparatus 200 operates normally, so that the ceramic heater 101 is normally heated, the temperature of the ceramic heater 101 is controlled within the range of about 150° C. to 200° C. The power reduced by the heat receiving conductor 104 is within the range of 0.0% to 0.5% in a state in which the temperature of the ceramic heater 101 is increased from a room temperature to a target temperature suitable for fixing the toner. The amount of electric power needed after the temperature of the ceramic heater 101 reaches the target temperature is only electric power for keeping the temperature of the ceramic heater 101. The necessary power is about 300 W. Consequently, the influence of the heat receiving conductor 104 on the temperature of the ceramic heater 101 is negligibly small in a state in which the ceramic heater 101 operates normally.

In the first embodiment, the two heat generation resistors 103 are disposed parallel to each other on the substrate 102. The heat receiving conductor 104 extends in the longitudinal direction of the heat generation resistors 103 and is disposed between the two heat generation resistors 103 in the lateral direction of the heat generation resistors 103. This makes it easy to transmit the heat generated from the heat generation resistors 103 to the heat receiving conductor 104, reducing the current flowing in the heat generation resistors 103 in a short time.

Second Embodiment

Figure 6:
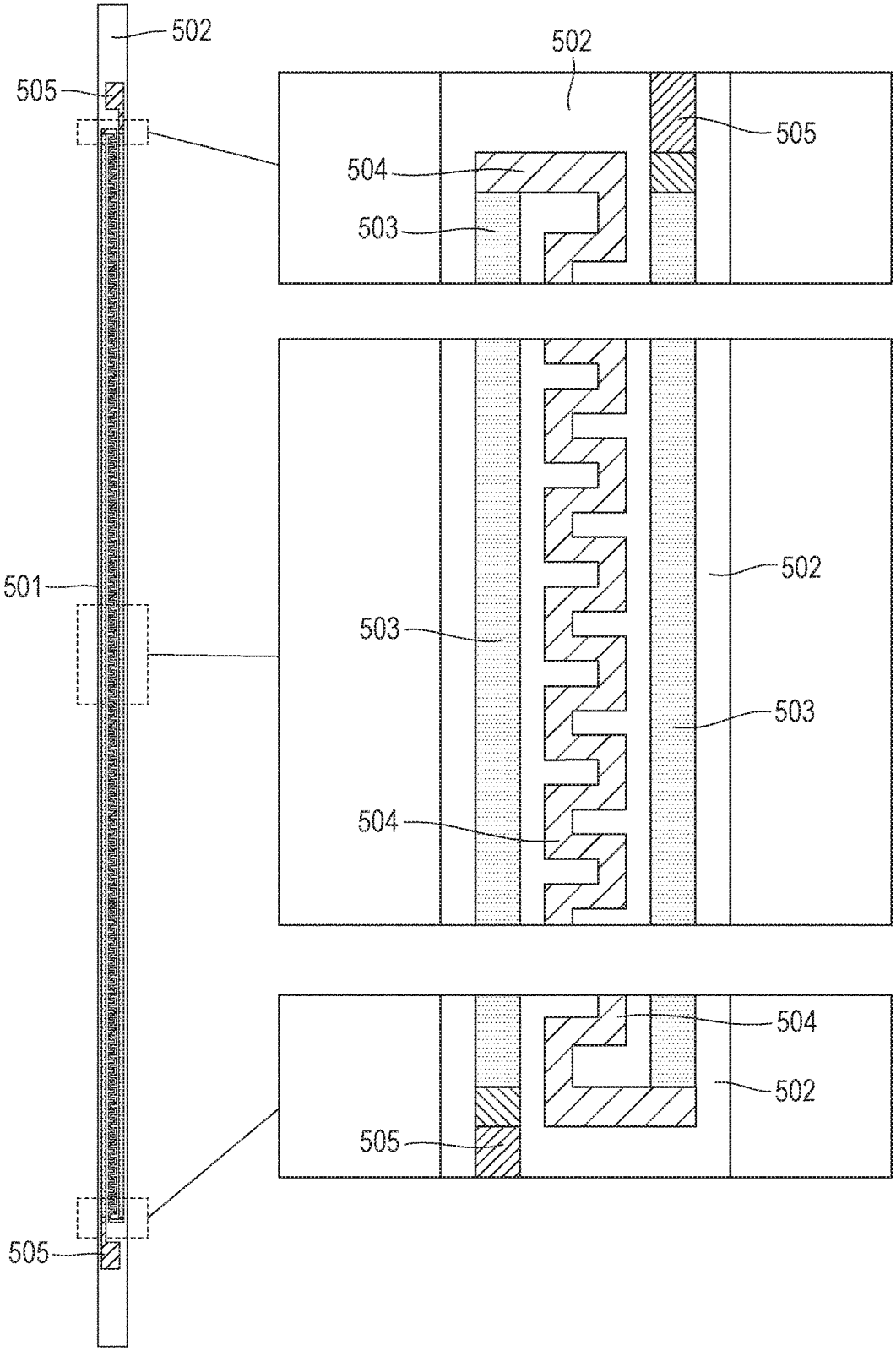
FIG. 6 is a schematic diagram of a ceramic heater according to a second embodiment of the present disclosure.

A second embodiment will be described with reference to the drawings. FIG. 6 is a schematic diagram of a ceramic heater 501 according to the second embodiment. The ceramic heater 501 is a long-thin-plate-like heater with low heat capacity. Components of the second embodiment having the same functions as those of the first embodiment are denoted by the same reference signs, and descriptions thereof will be omitted.

The ceramic heater 501 according to this embodiment includes a ceramic substrate 502, two heat generation resistors 503, a heat receiving conductor (a conductor) 504, and two conducting portions 505. The ceramic substrate 502 is a substrate made of ceramic. The heat generation resistors 503 generate heat when supplied with electric power, as the heat generation resistors 103 of the first embodiment do. The heat receiving conductor 504 is heated by the heat generation resistors 503 via the ceramic substrate 502, as the heat receiving conductor 104 of the first embodiment is. The heat generation resistors 503 and the heat receiving conductor 504 are electrically connected in series. The conducting portions 505 are contacts for connecting the heat generation resistors 503 and the heat receiving conductor 504 to the alternate-current source AC. The conducting portions 505 are disposed in the vicinity of both ends of the ceramic substrate 502 in the longitudinal direction.

In this embodiment, the ceramic heater 501, the temperature fuse 206, the energization control device 301, and the alternate-current source AC are connected in series, as in the first embodiment. The resistance $R_{H\text{-}25}$ of the heat generation resistors 503 is about 59Ω, and the temperature coefficient of resistance $TCR_H$ of the heat generation resistors 503 is about 700 ppm/deg under an environment of 25° C., as in the first embodiment. The heat generation resistors 503 are made of, for example, a mixture of silver and palladium, and are about 0.9 mm in width and about 220 mm in length.

In this embodiment, the two heat generation resistors 503 are disposed parallel to each other on the ceramic substrate 102.

In the second embodiment, the heat receiving conductor 504 is shaped like a ladder with silver and is about 0.6 mm in width and about 5 μm in thickness. The length of the heat receiving conductor 504 in the longitudinal direction is about 380 mm. The resistance $R_{S\text{-}25}$ of the heat receiving conductor 504 under an environment of 25° C. is about 1Ω, as in the first embodiment. In the second embodiment, the two heat generation resistors 503 are disposed in the vicinity of both sides of the ceramic substrate 502 in the lateral direction.

The two heat generation resistors 503 are disposed parallel to the longitudinal direction of the ceramic substrate 502. The ladder-shaped heat receiving conductor 504 is disposed between the two heat generation resistors 503. The heat receiving conductor 504 extends in the longitudinal direction of the ceramic substrate 502 and is disposed on the ceramic substrate 502. The heat receiving conductor 504 is connected to the heat generation resistors 503 in the vicinity of both ends of the heat receiving conductor 504 in the longitudinal direction of the ceramic substrate 502.

The temperature coefficient of resistance $TCR_S$ of the heat receiving conductor 504 depends on the material of the heat receiving conductor 504. For example, if the heat receiving conductor 504 is made of a material containing silver as the main component, the temperature coefficient of resistance $TCR_S$ of the heat receiving conductor 504 is about 3,000 ppm/deg, as in the first embodiment. For this reason, when the heat generation resistors 503 are heated, the resistance of the heat receiving conductor 504 changes in the same manner as the resistance of the heat receiving conductor 104, although the heat receiving conductor 504 of the second embodiment has a different shape from the shape of the heat receiving conductor 104 according to the first embodiment. The resistance $R_{S\text{-}1000}$ of the heat receiving conductor 504 is about 3.7Ω when the heat generation resistors 503 is at an increased temperature of around 900° C. at which the ceramic heater 501 can be damaged. This reduces electric power supplied to the heat generation resistors 503, thus preventing an increase in the temperature of the heat generation resistors 503, as in the first embodiment. This increases the time until the heater 501 reaches a temperature of 900° C., thereby providing a sufficient time for the temperature fuse 206 to operate.

Thus, the second embodiment produces the same advantages as in the first embodiment even if the shape of the heat receiving conductor 504 differs.

The ceramic heater 501 of the second embodiment is also used in the fixing apparatus 200 according to the first embodiment. The ceramic substrate 502 according to the second embodiment and the ceramic substrate 102 according to the first embodiment have the same configuration. The heat generation resistors 503 according to the second embodiment and the heat generation resistors 103 according to the first embodiment have the same configuration.

Third Embodiment

Figure 7:
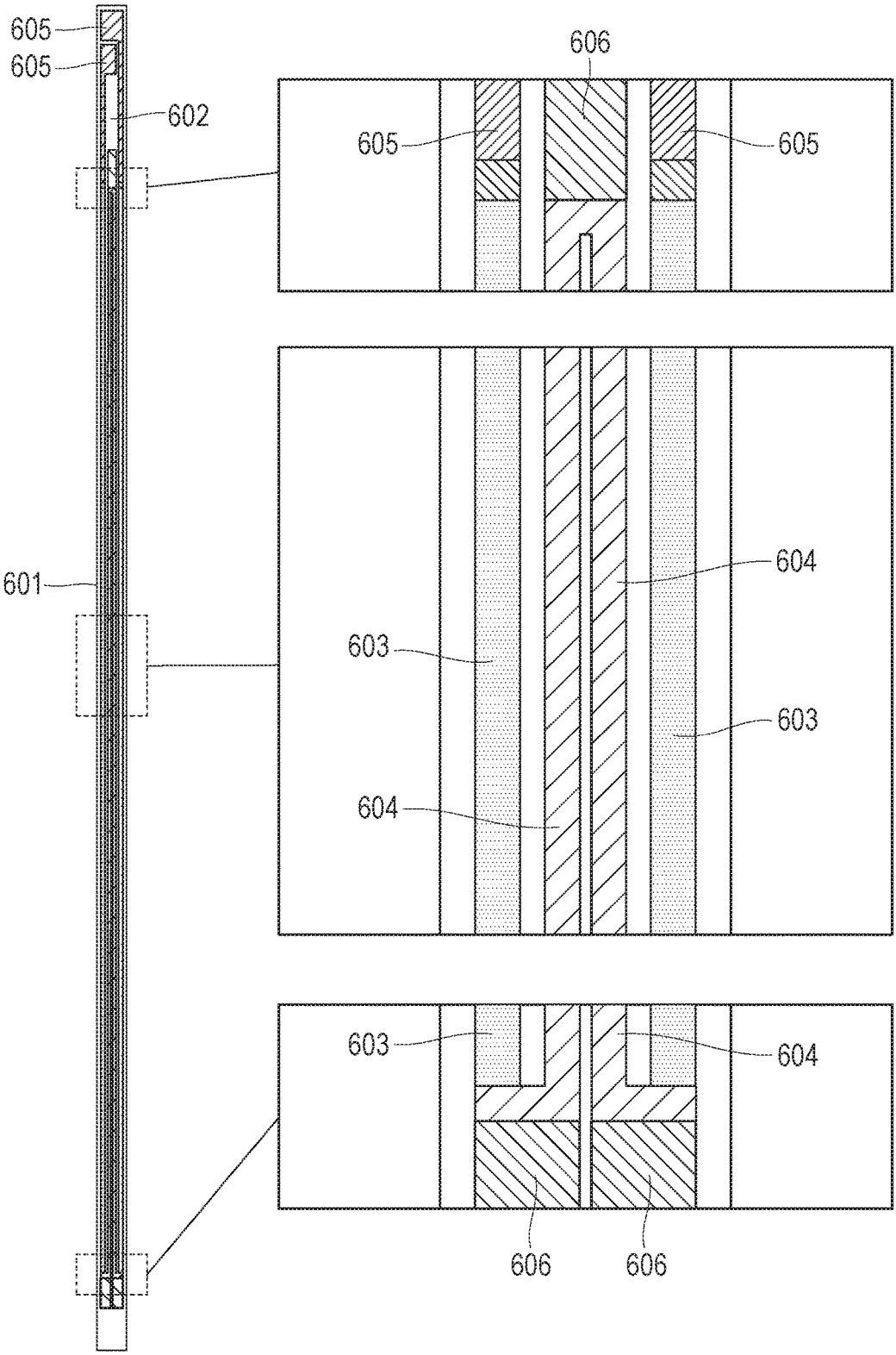
FIG. 7 is a schematic diagram of a ceramic heater according to a third embodiment of the present disclosure.

A third embodiment will be described with reference to the drawings. FIG. 7 is a schematic diagram of a ceramic heater 601 according to the third embodiment. The ceramic heater 601 is a long-thin-plate-like heater with low heat capacity. Components of the third embodiment having the same functions as those of the first embodiment are denoted by the same reference signs, and descriptions thereof will be omitted.

The ceramic heater 601 includes a ceramic substrate 602, two heat generation resistors 603, a heat receiving conductor 604, two conducting portions 605, two heat absorbing portions 606, and a glass protective layer (not shown). The ceramic substrate 602 has insulating properties and has a long thin plate-like shape. The ceramic substrate 602 has high thermal conductivity. If the ceramic substrate 602 is made of alumina, the thermal conductivity of the ceramic substrate 602 is about 20 W/(m·K).

The two heat generation resistors 603 are disposed on the ceramic substrate 602 and generate heat when supplied with electric power. The heat generation resistors 603 are supplied with electric power via the conducting portions 605. The heat absorbing portions 606 are disposed at both ends of the heat receiving conductor 604 in the longitudinal direction of the ceramic substrate 602. The material of the heat absorbing portions 606 is the same as the material of the heat receiving conductor 604. The glass protective layer (not shown) coats the heat generation resistors 603, the heat receiving conductor 604, and part of the conducting portions 605 and has high insulation properties.

The resistance $R_{S601}$ of the heat receiving conductor 604 is smaller than the resistance $R_{H601}$ of the heat generation resistors 603. The temperature coefficient of resistance $TCR_{H601}$ of the heat generation resistors 603 is larger than the temperature coefficient of resistance $TCR_{S601}$ of the heat receiving conductor 604 and is a positive temperature coefficient. The heat receiving conductor 604 is connected to the heat generation resistors 603 in the vicinity of both ends of the heat receiving conductor 604 in the longitudinal direction of the ceramic substrate 602. The heat generation resistors 603 and the heat receiving conductor 604 are electrically connected in series.

The two heat generation resistors 603 are respectively disposed in the vicinity of both sides of the ceramic substrate 602 in the lateral direction and extend in the longitudinal direction of the ceramic substrate 602. The heat receiving conductor 604 is disposed between the two heat generation resistors 603 and extend in the longitudinal direction of the ceramic substrate 602. This disposition of the heat generation resistors 603 and the heat receiving conductor 604 allows heat generated in the heat generation resistors 603 to be transmitted to the heat receiving conductor 604 via the ceramic substrate 602.

The resistance $R_{H601\text{-}25}$ of the heat generation resistors 603 under an environment of 25° C. is about 59Ω. The heat generation resistors 603 are made of a material with which the temperature coefficient of resistance $TCR_{H601}$ of the heat generation resistors 603 is about 700 ppm/deg (for example, a mixture of silver and palladium) and have a width of about 0.9 mm and a length of about 220 mm. In this embodiment, the two heat generation resistors 603 are disposed parallel to each other on the ceramic substrate 602. The heat receiving conductor 604 is about 0.7 mm in width, about 10 μm in thickness, and about 440 mm total length, and is made of a material containing silver as the main component. The resistance $R_{S601\text{-}25}$ of the heat receiving conductor 604 under an environment of 25° C. is about 1Ω. The temperature coefficient of resistance $TCR_{S601}$ of the heat receiving conductor 604 is about 3,000 ppm/deg.

Figure 8:
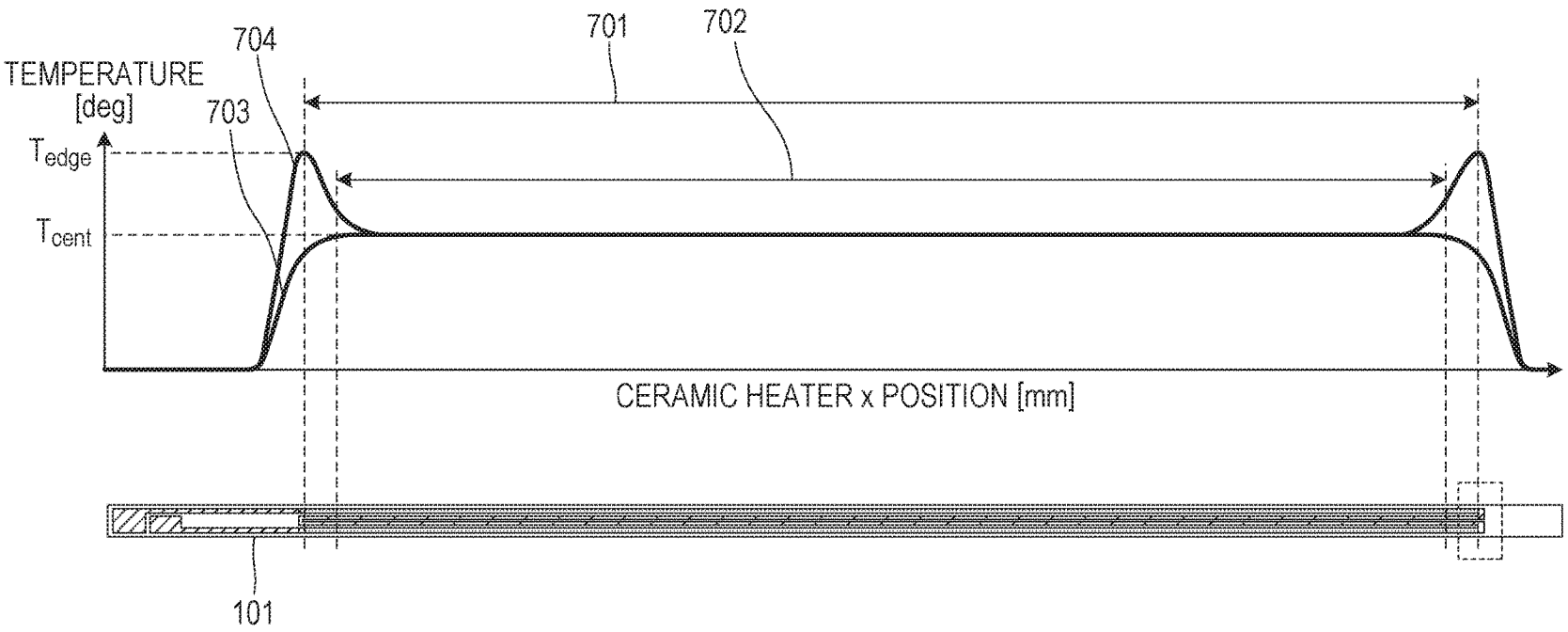
FIG. 8 is a diagram illustrating the heat distribution of the ceramic heater according to the first embodiment.

FIG. 8 is a diagram illustrating the heat distribution of the heat generation resistors 103 of the first embodiment in the longitudinal direction of the ceramic heater 101. A range 701 is the maximum width of a recording medium that the fixing apparatus including the ceramic heater 101 can heat. One example of a recording medium with the same width as the range 701 is a LTR-size recording medium (215.9 mm×279.4 mm). A range 702 is the width of a recording medium with a width smaller than the LTR size. One example of a recording medium with the same width as the range 702 is an A4-size recording medium (210 mm×297 mm).

In the ceramic heater 101 according to the first embodiment, the range of the heat generation resistors 103 is set so that a heat distribution 703 can be obtained to provide high fixing performance to a LTR-size recording medium. However, when an A4-size recording medium is heated using the ceramic heater 101, the heat from the ceramic heater 101 is transmitted to the recording medium only in the range 702. The heat from the ceramic heater 101 is not transmitted to the recording medium in ranges other than the range 702. For this reason, when an A4-size recording medium is heated, the ceramic heater 101 exhibits a heat distribution 704. In this case, the heat of the ceramic heater 101 is not transmitted to the recording medium in ranges other than the range 702, increasing the temperature of the ceramic heater 101 in the other ranges.

Figure 9:
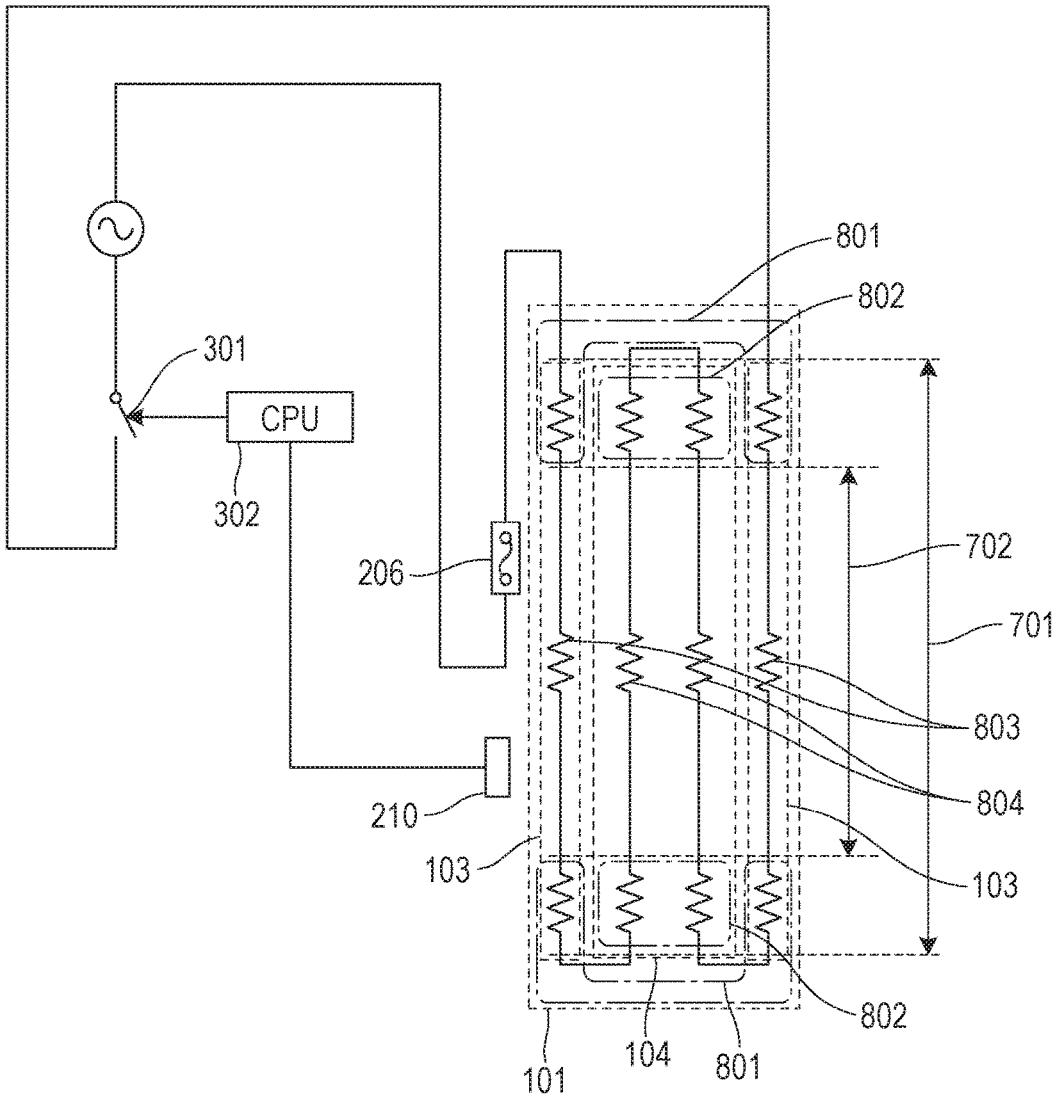
FIG. 9 is an equivalent circuit diagram illustrating the resistance distribution of the ceramic heater according to the first embodiment.
Figure 10:
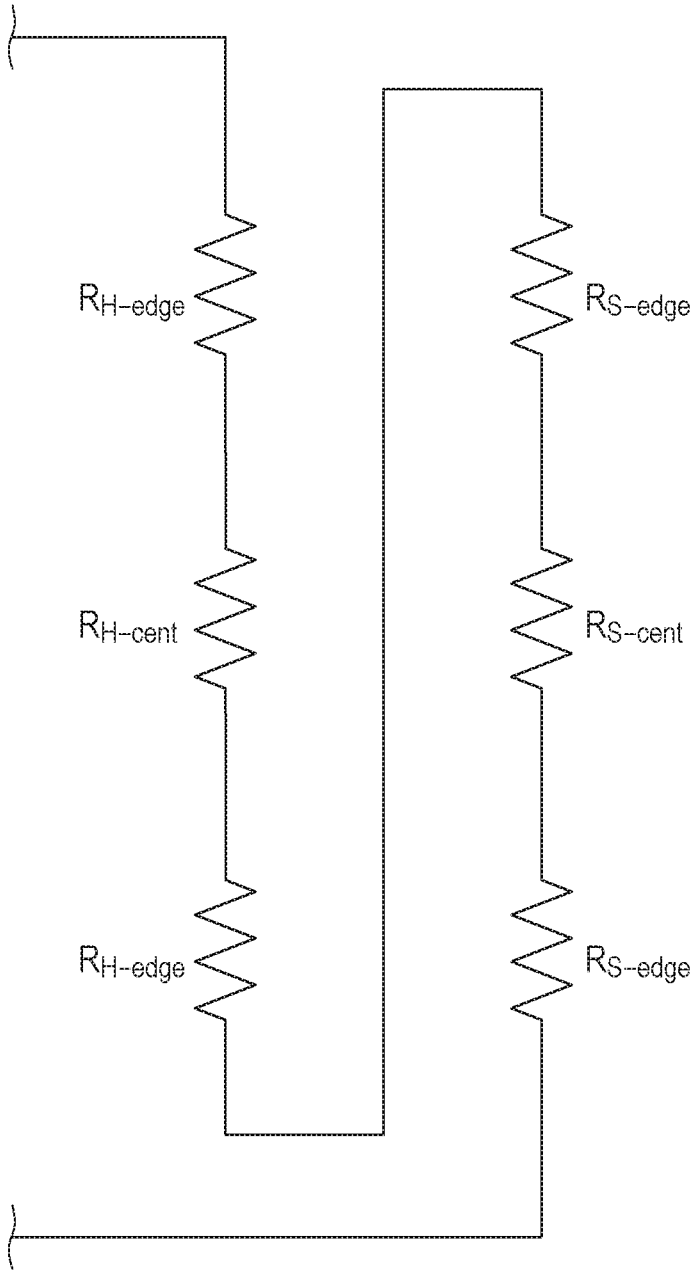
FIG. 10 is a simplified equivalent circuit illustrating the resistance distribution of the ceramic heater according to the first embodiment.

FIG. 9 is an equivalent circuit diagram illustrating the resistance distribution of the heat generation resistors 103 and the heat receiving conductor 104 of the ceramic heater 101 according to the first embodiment. FIG. 10 is a simplified equivalent circuit illustrating the resistance distribution of the heat generation resistors 103 and the heat receiving conductor 104 of the ceramic heater 101 according to the first embodiment. Partial resistor 801 is the resistor of the heat generation resistors 103 in the range 701 and out of the range 702. The resistance of the partial resistor 801 is $R_{H\text{-}edge}$. Partial resistor 802 is the resistor of the heat receiving conductor 104 in the range 701 and out of the range 702. The resistance of the partial resistor 802 is $R_{S\text{-}edge}$. The partial resistor 801 is the partial resistor of the heat generation resistors 103 at one end of the ceramic heater 101 in the longitudinal direction, and the partial resistor 802 is the partial resistor of the heat receiving conductor 104 at the other end of the ceramic heater 101 in the longitudinal direction.

Partial resistor 803 is the resistor of the heat generation resistors 103 in the range 702, and the resistance of the partial resistor 803 is resistance $R_{H\text{-}cent}$. Partial resistor 804 is the resistor of the heat receiving conductor 104 in the range 702, and the resistance of the partial resistor 804 is resistance $R_{S\text{-}cent}$. The resistance $R_H$ of the heat generation resistors 103 and the resistance $R_S$ of the heat receiving conductor 104 are expressed as the following Eqs. (4) and (5).

$$R_H = R_{H\text{-}edge} \times 2 + R_{H\text{-}cent} \tag{3}$$

$$R_S = R_{S\text{-}edge} \times 2 + R_{S\text{-}cent} \tag{4}$$

The resistance $R_{H\text{-}edge}$ to $R_{S\text{-}cent}$ of the partial resistors 801 to 804 are expressed as the following Eqs (5) to (8).

$$R_{H\text{-}edge} = R_{H\text{-}edge25^\circ C.} \times \{1 + TCR_H \times (T_{edge} - 25^\circ C.)\} \tag{5}$$

$$R_{H\text{-}cent} = R_{H\text{-}cent25^\circ C.} \times \{1 + TCR_H \times (T_{cent} - 25^\circ C.)\} \tag{6}$$

$$R_{S\text{-}edge} = R_{S\text{-}edge25^\circ C.} \times \{1 + TCR_S \times (T_{edge} - 25^\circ C.)\} \tag{7}$$

$$R_{S\text{-}cent} = R_{S\text{-}cent25^\circ C.} \times \{1 + TCR_S \times (T_{cent} - 25^\circ C.)\} \tag{8}$$

where $T_{edge}$ is the temperature of the ceramic substrate 102 in the range 701 and out of the range 702, $T_{cent}$ is the temperature of the ceramic substrate 102 in the range 702, $R_{H\text{-}edge25^\circ C.}$ is the resistance of the partial resistor 801 under an environment of 25° C., $R_{H\text{-}cent25^\circ C.}$ is the resistance of the partial resistor 803 under an environment of 25° C., $R_{S\text{-}edge25^\circ C.}$ is the resistance of the partial resistor 802 under an environment of 25° C., and $R_{S\text{-}cent25^\circ C.}$ is the resistance of the partial resistor 804 under an environment of 25° C.

The voltage applied to the ceramic heater 101 from the commercial power supply is constant at 230 Vac. The amount of heat consumed in the partial resistor 801 is proportional to a value obtained by dividing the square of a voltage applied to the partial resistor 801 by the resistance $R_{H\text{-}edge}$ of the partial resistor 801 (power $P=V^2/R$). The amount of heat consumed in the partial resistor 802 is proportional to a value obtained by dividing the square of a voltage applied to the partial resistor 802 by the resistance $R_{S\text{-}edge}$ of the partial resistor 802 (power $P=V^2/R$).

Eqs. (3) and (4) and Eqs. (5) to (8) show that the partial resistor $R_{H\text{-}edge}$ has a linear relationship with the difference between the temperature $T_{edge}$ and 25° C., that the partial resistance $R_{S\text{-}edge}$ has a linear relationship with the difference between the temperature $T_{cent}$ and 25° C., that the partial resistor $R_{H\text{-}edge}$ has a linear relationship with the temperature coefficient of resistance $TCR_H$, and that the partial resistor $R_{S\text{-}edge}$ has a linear relationship with the temperature coefficient of resistance $TCR_S$. Furthermore, Eqs. (5) to (8) show that this is a positive feedback circuit.

Since the first embodiment does not include the heat absorbing portions 606 at an end of the heat receiving conductor 104, the temperature can rise at both ends of the ceramic heater 101 in the longitudinal direction. Image forming apparatuses are generally set to form images on LTR-size recording media. However, when an A4-size recording medium with a width smaller than the width of the LTR-size recording medium passes through the fixing apparatus, the ceramic heater 101 can overheat in the range 701 and out of the range 702.

This causes the heat of the ceramic heater 101 to be directly transmitted to the pressure roller 204 without passing through the recording medium 211, deforming the outer shape of the pressure roller 204 by heat. This can hinder application of uniform stress from the pressure roller 204 to the fixing film 203, causing large stress to be partially applied to the fixing film 203. To prevent this, the ceramic heater 601 of the third embodiment includes the heat absorbing portions 606 at the end of the heat receiving conductor 604 in the longitudinal direction of the ceramic heater 601. The material of the heat absorbing portions 606 contains silver as the main component, as with the heat receiving conductor 604.

Figure 11:
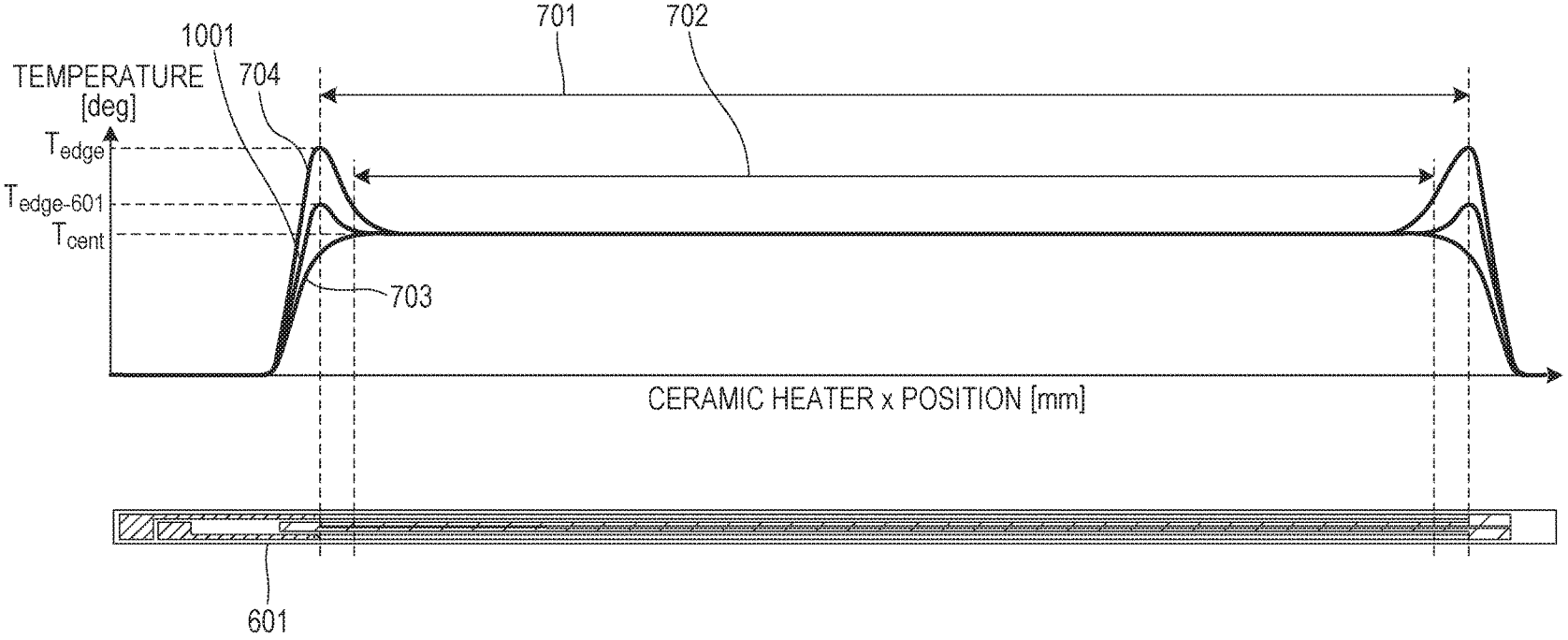
FIG. 11 is a diagram illustrating the heat distribution of the ceramic heater according to the third embodiment.

FIG. 11 is a diagram illustrating the heat distribution of the ceramic heater 601 according to the third embodiment. The heat absorbing portions 606 extend out of the range 701 in the longitudinal direction of the ceramic heater 601. The thermal conductivity of the heat receiving conductor 604 (about 420 W/m·K) is set higher than the thermal conductivity (about 20 W/(m·K)) of the ceramic substrate 602. This allows the heat in the range 701 and out of the range 702 to be transmitted to the heat absorbing portions 606, thus escaping out of the range 701. In the third embodiment, this reduces the difference between the temperature $T_{edge}$ and the temperature $T_{cent}$, as shown by a heat distribution 1001.

In this embodiment, the length of the heat absorbing portions 606 in the longitudinal direction of the ceramic heater 601 is about 20 mm. Since the resistance of the heat absorbing portions 606 is 1 mΩ or less, while the resistance $R_{S601\text{-}25}$ of the heat receiving conductor 604 is about 1Ω, the resistance of the heat absorbing portions 606 is negligibly smaller than the resistance $R_{S601\text{-}25}$ of the heat receiving conductor 604.

In an overheated state in which power to the ceramic heater 601 has to be shut off using the temperature fuse 206, the heat generation resistors 603 are in an overheated state across the entire ceramic substrate 602 in the longitudinal direction. For this reason, the difference between the temperature $T_{edge}$ and the temperature $T_{cent}$ is small in the overheated state, and the influence of the heat absorption with the heat absorbing portions 606 is small. This allows this embodiment to delay the time until the fixing apparatus is damaged in the overheated state, as with the fixing apparatus 200 of the first embodiment.

Fourth Embodiment

Figure 12:
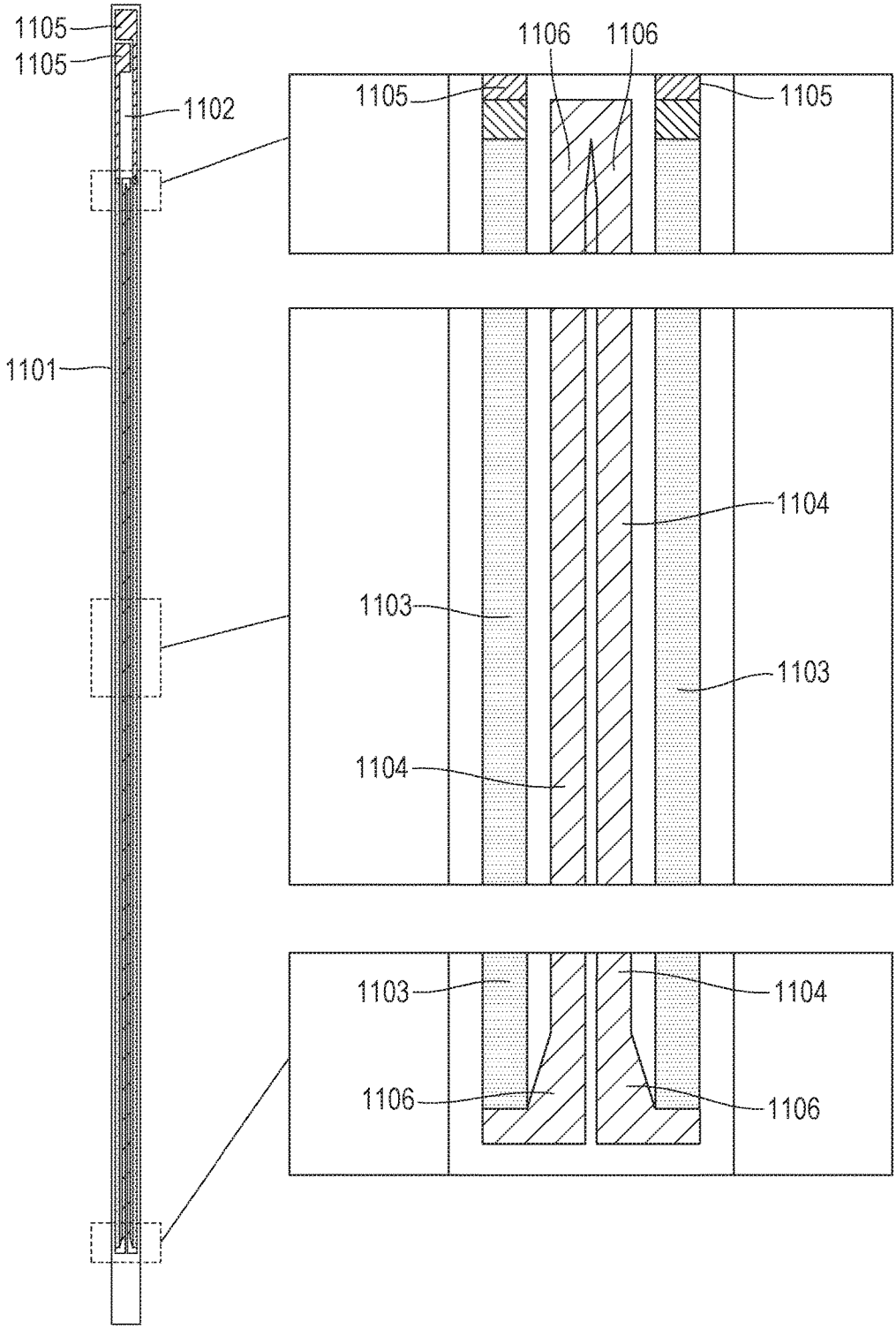
FIG. 12 is a schematic diagram of a ceramic heater according to a fourth embodiment of the present disclosure.
Figure 13:
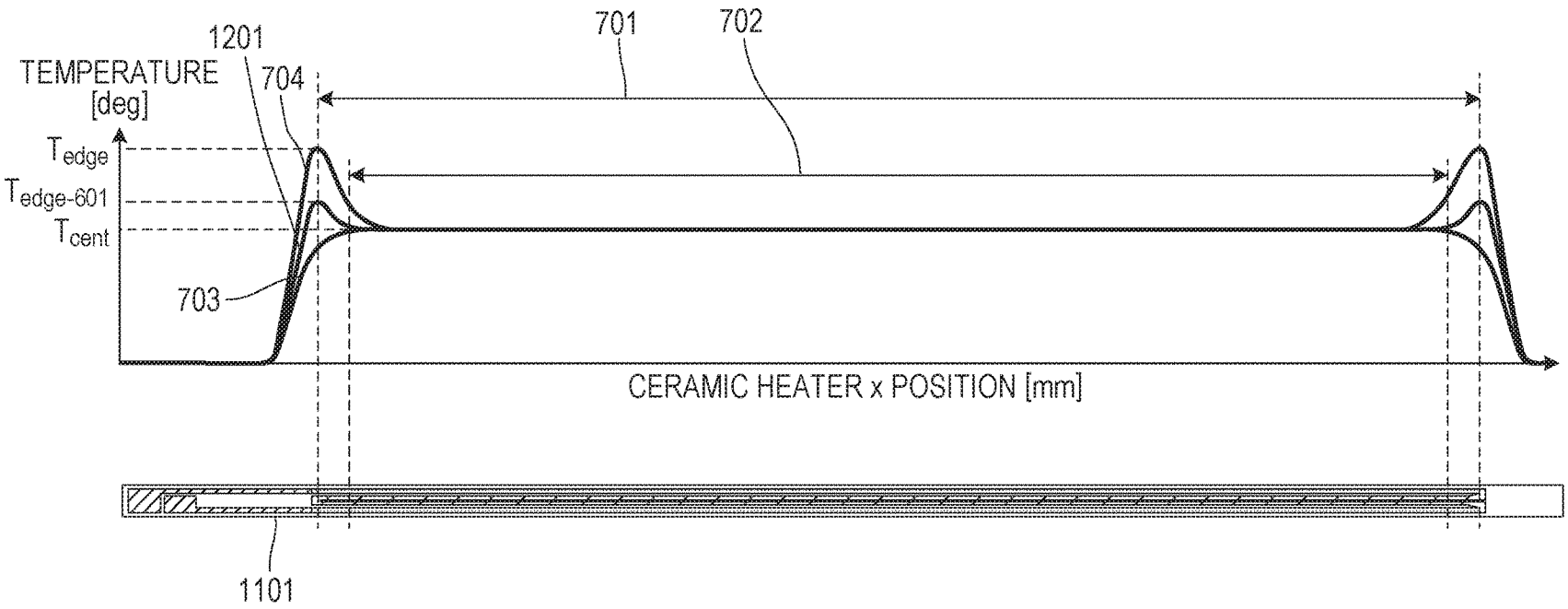
FIG. 13 is a diagram illustrating the heat distribution of the ceramic heater according to the fourth embodiment.
Figure 14:
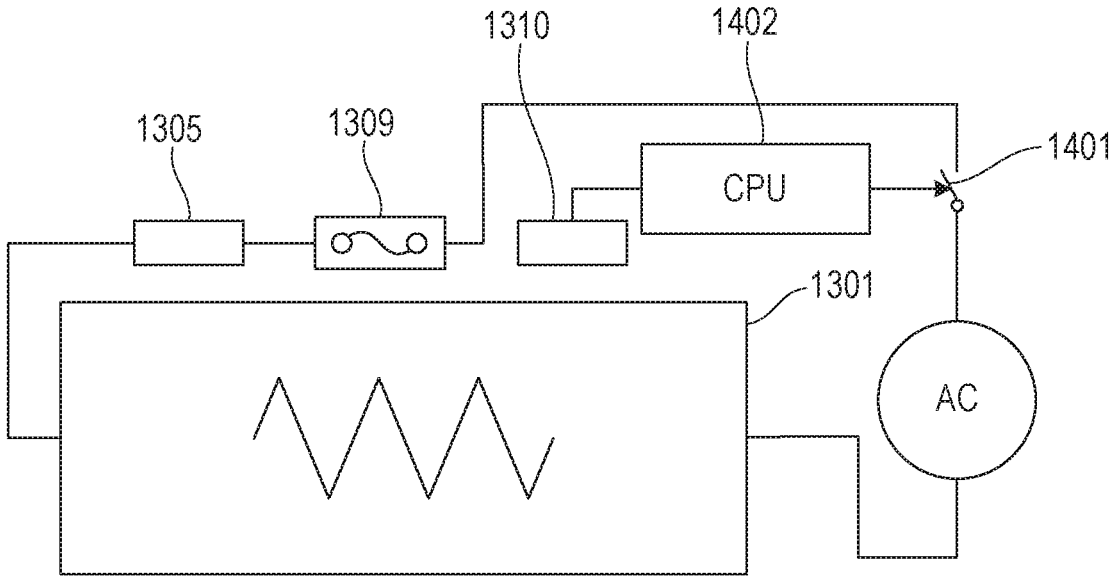
FIG. 14 is a schematic electrical circuit diagram of a known fixing apparatus.

A fourth embodiment will now be described. FIG. 12 is a schematic diagram of a ceramic heater 1101 according to the fourth embodiment. FIG. 13 is a diagram illustrating the heat distribution of the ceramic heater 1101 according to the fourth embodiment. In the fourth embodiment, components having the same functions as those of the first embodiment will be given the same reference signs, and descriptions thereof will be omitted.

As described above, the third embodiment reduces an increase in temperature at both ends of the ceramic heater 601 by using the heat absorbing portions 606 at the ends of the heat receiving conductor 604 in the longitudinal direction of the ceramic heater 601. However, to dispose the heat absorbing portions 606 in the ceramic heater 601, the ceramic substrate 602 needs to have a sufficient length in the longitudinal direction.

Furthermore, this increases the range of portions electrically connected to the commercial power supply in the longitudinal direction of the ceramic substrate 602 on the side of the ceramic heater 601 on which the conducting portions 605 are not disposed (the lower side in FIG. 7). The portions electrically connected to the commercial power supply refer to the heat generation resistors 603, the heat receiving conductor 604, the conducting portions 605, and the heat absorbing portions 606. Safety standard, such as IEC60950, requires that an electrical circuit unit which the user can touch and the portions electrically connected to the commercial power supply have a reinforced insulation configuration or a double insulation configuration. The electrical circuit unit which the user can touch refers to an electrical circuit disposed at a position at which the user can touch the electrical circuit and a component that is electrically connected to the electrical circuit (for example, a thermistor). The electrical circuit unit which the user can touch and the heat absorbing portions 606 need a sufficient insulation distance therebetween. Since the third embodiment includes the heat absorbing portions 606, the position of the electrical circuit unit is limited in the vicinity of the ceramic heater 601.

For this reason, the ceramic heater 1101 of the fourth embodiment does not include the heat absorbing portions 606 but includes resistance offset portions 1106. In other words, ends 1106 of a heat receiving conductor 1104 in the longitudinal direction of the ceramic heater 1101 are wider in the lateral direction of the ceramic heater 1101 than the center in the longitudinal direction. This prevents an increase in the temperature in the vicinity of both ends in the longitudinal direction of the ceramic heater 1101.

The width of the heat receiving conductor 1104 in the vicinity of the ends of the heat receiving conductor 1104 in the longitudinal direction of two heat generation resistors 1103 is larger than the width of portions of the heat receiving conductor 1104 other than the vicinity of the ends. The width of the heat receiving conductor 1104 in the vicinity of the ends of the heat receiving conductor 1104 increases with a decreasing distance to the ends of the heat receiving conductor 1104.

The total resistance $R_{H1101\text{-}25}$ of the heat generation resistors 1103 under an environment of 25° C. is about 59Ω. The heat generation resistors 1103 are made of a material with a temperature coefficient of resistance $TCR_{H1101}$ of about 700 ppm/deg (for example, a mixture of silver and palladium) and has a width of about 0.9 mm and a length of about 220 mm. In this embodiment, the two heat generation resistors 1103 extend in the longitudinal direction of a ceramic substrate 1102. The heat receiving conductor 1104 is about 0.7 mm in width, about 10 μm in thickness, about 420 mm in total length and is made of a material containing silver as the main component.

The resistance $R_{S1101\text{-}25}$ of the heat receiving conductor 1104 under an environment of 25° C. is about 1Ω, and the temperature coefficient of resistance $TCR_{S1101}$ of the heat receiving conductor 1104 is about 3,000 ppm/deg. The resistance offset portions 1106 are made of the same material as that of the heat receiving conductor 1104 and are about 40 mm in total length and about 0.9 mm in average width. The total resistance $R_{S1106\text{-}25}$ of the resistance offset portions 1106 under an environment of 25° C. is about 70 mΩ.

The resistance $R_{S1101}$ of the heat receiving conductor 1104 and the total resistance $R_{S1106}$ of the resistance offset portions 1106 are expressed as the following Eqs. (9) to (11).

$$R_{S1101}=R_{S1106}\times 2+R_{S1101\text{-}cent} \tag{9}$$

$$R_{S1106}=R_{S1106\ 25^\circ\ C.}\times\{1+TCR_{S1101}\times(T_{edge}-25^\circ\ C.)\} \tag{10}$$

$$R_{S1101\text{-}cent}=R_{S1101\ cent\ 25^\circ\ C.}\times\{1+TCR_{S1101}\times(T_{cent}-25^\circ\ C.)\} \tag{11}$$

where $R_{S1101\text{-}cent}$ is the resistance of the heat receiving conductor 1104 in the range 702 (the definition of the range 702 is the same as that of the third embodiment), $R_{S1106\ 25^\circ\ C.}$ is the resistance $R_{S1106}$ of the resistance offset portions 1106 under an environment of 25° C., and $R_{S1101\text{-}cent\ 25^\circ\ C.}$ is a resistance $R_{S1101\text{-}cent}$ under an environment of 25° C. The definitions of the temperature $T_{edge}$ and temperature $T_{cent}$ are the same as those of the third embodiment.

As expressed in Eqs. (9) to (11), the resistance $R_{S1101}$ and the resistance $R_{S1106}$ of this embodiment are also influenced by the temperature coefficient of resistance $TCR_{S1101}$. However, in this embodiment, the resistance of the resistance offset portions 1106 of the heat receiving conductor 1104 per unit length is set lower than the resistance of the heat receiving conductor 1104 per unit length. Specifically, the cross-sectional areas of the resistance offset portions 1106 are increased by making the width of the resistance offset portions 1106 larger than the width of the heat receiving conductor 1104, thereby decreasing the resistance $R_{S1106}$ of the resistance offset portions 1106. This causes the resistance $R_{S1106}$ at both ends of the ceramic heater 1101 in the fourth embodiment to be lower than the resistance $R_{S\text{-}edge}$ in the third embodiment.

Since the temperature of a resistor decreases as the resistance decreases. Therefore, when the resistance $R_{S1106}$ of the resistance offset portions 1106 decreases, the temperature of the resistance offset portions 1106 also decreases. This allows an increase in temperature at both ends of the ceramic heater 1101 to be reduced even without the heat absorbing portions 606 in the ceramic heater 1101, as shown in the heat distribution 1201 in FIG. 13. When the ceramic heater 1101 becomes overheated, the increase in the resistance $R_{S1101}$ delays the time until the ceramic heater 1101 is damaged, as in the third embodiment.

Although the material of the heat receiving conductors in the above embodiments is silver, the material of the heat receiving conductors is not limited to silver. The heat receiving conductors may be made of any material having a lower resistance and a higher temperature coefficient of resistance than the heat generation resistors and having a positive temperature coefficient of resistance. While the heat receiving conductors and the heat generation resistors of the above embodiments have substantially the same length in the longitudinal direction of the substrate, this is not intended to limit the present disclosure. The advantageous effects are given also when the heat generation resistors and the heat receiving conductor have different lengths.

Furthermore, the third embodiment and the fourth embodiment may be combined such that the heat receiving conductor includes the heat absorbing portions 606 according to the third embodiment and the resistance offset portions 1106 according to the fourth embodiment. This configuration prevents an increase in the temperature of the ceramic heater in the vicinity of the ends of the heat generation resistors more effectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-167521, filed Aug. 27, 2015, which is hereby incorporated by reference herein in its entirety.

What is claimed is:

1. A fixing apparatus that fixes a toner image formed on a recording medium to the recording medium, the apparatus comprising:

a tubular film; and a heater in contact with an inner surface of the film, wherein the heater comprises:

a substrate;

a first heat generation resistor on the substrate, the first heat generation resistor being arranged on the substrate parallel with a longitudinal direction of the substrate;

a second heat generation resistor on the substrate, the second heat generation resistor being arranged on the substrate parallel with the longitudinal direction of the substrate; and a conductor electrically connecting the first heat generation resistor and the second heat generation resistor to each other, wherein at least part of the conductor is disposed in an area, in the longitudinal direction, in which the first heat generation resistor is disposed, and the part of the conductor disposed in the area is disposed between the first heat generation resistor and the second heat generation resistor in a lateral direction of the substrate, wherein one end of the conductor is electrically connected to the first heat generation resistor at a position of an end of the first heat generation resistor in the longitudinal direction, and the other end of the conductor is electrically connected to the second heat generation resistor at a position of an end of the second heat generation resistor in the longitudinal direction, wherein the part of the conductor disposed in the area is in contact with neither the first heat generation resistor nor the second heat generation resistor, wherein, in a range of 25° C. to 900° C., the conductor has a resistance lower than a total resistance of the first heat generation resistor and the second heat generation resistor, and wherein the conductor has a temperature coefficient of resistance larger than a temperature coefficient of resistance of the first heat generation resistor.

2. The fixing apparatus according to claim 1, wherein, in the range of 25° C. to 900° C., the resistance of the conductor is 5% or less of the total resistance of the first heat generation resistor and the second heat generation resistor, and wherein the temperature coefficient of resistance of the conductor is four or more times the temperature coefficient of resistance of the first heat generation resistor.

3. The fixing apparatus according to claim 1, wherein the first and second heat generation resistors and the conductor are coated with a glass layer.

4. The fixing apparatus according to claim 1, wherein the conductor is larger in width in a lateral direction of the substrate at an end in the longitudinal direction than a central portion in the longitudinal direction.

5. The fixing apparatus according to claim 1, wherein a length of the part pf the conductor disposed in the area in the longitudinal direction is substantially the same as a length of the first heat generation resistor in the longitudinal direction.

6. A heater for use in a fixing apparatus, the heater comprising:

a substrate;

a first heat generation resistor on the substrate, the first heat generation resistor being arranged on the substrate parallel with a longitudinal direction of the substrate;

a second heat generation resistor on the substrate, the second heat generation resistor being arranged on the substrate parallel with the longitudinal direction of the substrate; and a conductor electrically connecting the first heat generation resistor and the second heat generation resistor to each other, wherein at least part of the conductor is disposed in an area, in the longitudinal direction, in which the first heat generation resistor is disposed, and the part of the conductor disposed in the area is disposed between the first heat generation resistor and the second heat generation resistor in a lateral direction of the substrate, wherein one end of the conductor is electrically connected to the first heat generation resistor at a position of an end of the first heat generation resistor in the longitudinal direction, and the other end of the conductor is electrically connected to the second heat generation resistor at a position of an end of the second heat generation resistor in the longitudinal direction, wherein the part of the conductor disposed in the area is in contact with neither the first heat generation resistor nor the second heat generation resistor, wherein, in a range of 25° C. to 900° C., the conductor has a resistance lower than a total resistance of the first heat generation resistor and the second heat generation resistor, and wherein the conductor has a temperature coefficient of resistance larger than a temperature coefficient of resistance of the first heat generation resistor.

7. The heater according to claim 6, wherein, in the range of 25° C. to 900° C., the resistance of the conductor is 5% or less of the total resistance of the first heat generation resistor and the second heat generation resistor, and wherein the temperature coefficient of resistance of the conductor is four or more times the temperature coefficient of resistance of the first heat generation resistor.

8. The heater according to claim 6, wherein the first and second heat generation resistors and the conductor are coated with a glass layer.

9. The heater according to claim 6, wherein the conductor is larger in width in a lateral direction of the substrate at an end in the longitudinal direction than a central portion in the longitudinal direction.

10. The heater according to claim 6, wherein a length of the part of the conductor disposed in the area in the longitudinal direction is substantially the same as a length of the first heat generation resistor in the longitudinal direction.

* * * * *